United States Patent [19]

Packard

[11] 4,215,793

[45] Aug. 5, 1980

[54] ANTI-SPILL LID

[76] Inventor: George Packard, 14227 SW. 275 St., Naranja Lakes, Fla. 33032

[21] Appl. No.: 964,493

[22] Filed: Nov. 29, 1978

[51] Int. Cl.[2] ..... B65D 41/48

[52] U.S. Cl. ..... 220/270; 220/90.4; 229/7 R; 229/43

[58] Field of Search ..... 220/90.4, 268, 269, 220/270; 229/7 R, 43

[56] References Cited

U.S. PATENT DOCUMENTS

| | | | |
|---|---|---|---|
| 2,003,657 | 6/1935 | Stubblefield | 215/317 X |
| 3,404,988 | 10/1968 | Rausins | 229/7 R X |
| 3,701,454 | 10/1972 | Thorp | 220/270 |
| 3,777,968 | 12/1973 | Law | 229/43 X |
| 3,800,999 | 4/1974 | Serritella | 220/254 X |
| 3,977,559 | 8/1976 | Lombards | 220/254 X |
| 4,081,103 | 3/1978 | Zoellick | 220/90.4 |

*Primary Examiner*—Allan N. Shoap
*Attorney, Agent, or Firm*—Jack E. Dominik

[57] ABSTRACT

A releasably secured closure lid for potable containers having a perforated sectorial drinking section, the removal of which exposes inclined baffle walls. Potable waveforms generated by movement of the container impinge upon the baffle walls and rebound therefrom with reduced energy. The direction of rebound is toward the middle portion of the drinking section. The rebounding waves therefore converge upon each other from opposing directions and their individual kinetic energies are thereby dissipated by cancellation, thus reducing potable spillage.

3 Claims, 7 Drawing Figures

ANTI-SPILL LID

BACKGROUND OF THE INVENTION

1. Field of the Invention

This invention relates generally to closure lids for potable containers having an open top, and more particularly to closure lids having a tear-away drinking section provided therein, and more specifically to lids having baffle walls projecting upwardly and inwardly from the edges which define the drinking section.

2. Description of the Prior Art

Early attempts to solve the spillage problem inherent in the transportation of open top containers having potables therein produced the snap-on closure lid. Thus, the lid would be releasably secured to the rim of the container at the point of dispensation and remain so engaged, until the arrival of the hour of libation necessitated the detachment of the entire lid from the rim. Thus, spillage was avoided during the transportation of the potable from the point of dispensation to the point of consumption. The spillage problem again appeared, however, when the lid was removed. Therefore, cruciform slits or circular openings were formed centrally of the lid which were adapted to receive straws therethrough. Thus, removing the closure lid was no longer necessary. Since all drinks are not best enjoyed when taken by straw, the next generation of lids were provided with perforations formed therein, defining drinking sections. The user of such a lid merely needed to separate that section of the lid within the bounds of the perforation lines from the remaining major portion of the lid to create a drinking aperture. The need for straws was thus obviated, but the sloshing problem was still extant, although reduced somewhat.

Further efforts to reduce sloshing involved the making of a lid which was sloped to allow liquids splashing from the drinking section onto the top of the lid to drain back into the cup. This effort, disclosed in U.S. Pat. No. 3,868,043 to Freemyer (1975), was directed to returning the horse into the barn, as opposed to keeping the horse in the barn initially. The latter approach is taken by the present invention.

Another recent effort, shown in U.S. Pat. No. 3,938,695 to Russ, (1976), provided a plurality of grouped holes in a lid, through which liquid is imbibed. Baffle walls appear in the Russ device when the drinking section is depressed to allow the drinker to place his nose in aroma-receiving relationship with a grouping of holes provided for that purpose. These walls, however, slope downwardly and inwardly, thereby serving much the same purpose as the sloped lid disclosed by Freemyer.

Other efforts have become manifest in hingeably attached drinking flaps which may be opened and closed as desired, as shown in U.S. Pat. No. 3,994,411 to Elfelt et al (1976), and as shown in U.S. Pat. No. 4,081,103 to Zoellick (1978), wherein the flap swings downwardly, into the container cavity, and also in U.S. Pat. No. 4,056,210 to Boyle (1977), wherein the flap is torn away by a motion directed from the center of the lid to the outer portion thereof.

SUMMARY OF THE INVENTION

None of the prior art devices have shown a lid capable of harnessing the energy inherent in the waves appearing in the potable to achieve the anti-spill effect. The prior art devices are passive devices, in that they show no active feature to use the very wave motion the control of which is sought to coact with other wave forms to effect the cancellation of the energies contained therein.

A pulse of energy travelling through fluid will vertically displace the fluid momentarily as the pulse proceeds through the medium of the fluid. This results in the optical illusion that a given wave of fluid is itself travelling with the pulse of energy. If two such pulses collide, the energies inherent in each are effectively cancelled. This is consistent with the physical law of conservation of momentum, which says that the product of the mass and velocity of colliding objects will always be equal. Thus, a rubber ball bouncing on the earth imparts a velocity to the earth of negative polarity to that of the ball. The velocity is immeasurably small, due to the mass of the earth being so much greater than the mass of the ball. However, the product of the mass of the ball and the velocity of the ball must equal the product of the mass of the earth and the velocity imparted to the earth by the ball at the moment of collision. A complete dissertation of this principle appears in Azimov on Physics available at all public libraries.

In like manner, since the velocities of wave pulses travelling toward each other are by definition opposite in polarity, the momentum of each wave form is cancelled by the momentum of the other. This assumes that each wave form will be travelling at approximately the same velocity and that each wave form will contain approximately equal masses. Such an assumption is appropriate to the practice of the present invention, since the shock or movement which induces the formation of wave forms in the potable container will generate wave forms of approximately equal mass and velocity within the container.

The present invention therefore comprises structure which will direct the wave forms caused by sudden movement of the container to be directed toward a common area, where they will converge with other wave forms and effect self-cancellation.

The aiming means exemplary of the present structure comprises baffle walls formed integrally with the edge of the drinking section of the closure lid. The walls are inclined, in one embodiment, at a 45° angle relative to the plane of the lid. The angle could vary from 30° to 60°. The walls are further disposed to act cooperatively with each other, i.e., each point on the surface of the walls lies substantially on a plane perpendicular to an imaginary line connecting said point with the mid-area of the drinking section. Thus, whether the drinking section is sectorial or segmental, the baffle walls bordering said section or segment will direct waves impinging thereon toward a common area. This common area is the mid-area of the drinking section and is the point of convergence of wave forms and therefore the point of cancellation or annihilation of same.

A primary object of the lid is thus seen to be the inhibiting of spillage of potable by causing waves which could otherwise splash from the confines of the container to converge upon and collide with other such wave pulses travelling in opposite polarity velocity relationship therewith, effecting the cancellation of all such converging waves.

It is a further object to direct such waves by aiming means which comprise an integral part of the lid, and which is therefore economical and practical to manufacture.

It is a further object to provide a closure lid with a removable drinking section, wherein the removal of said removable drinking section exposes baffle walls which comprise the aiming means for directing the convergence of wave pulses.

These and other objects of the invention will become readily apparent as this description proceeds, and by reference to the drawings.

Brief Description of the Drawings

Further objects and advantages of the present invention will become apparent as the following description proceeds, taken in conjunction with the accompanying drawings in which.

Description of the Preferred Embodiment

Figure 2:
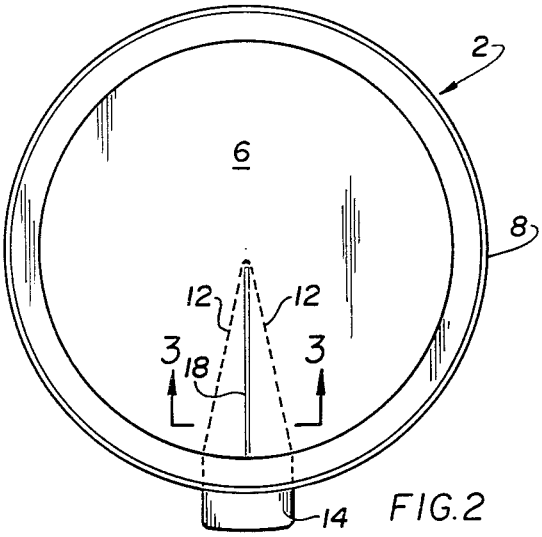
FIG. 2 shows an elevational view of the preferred embodiment.
Figure 1:
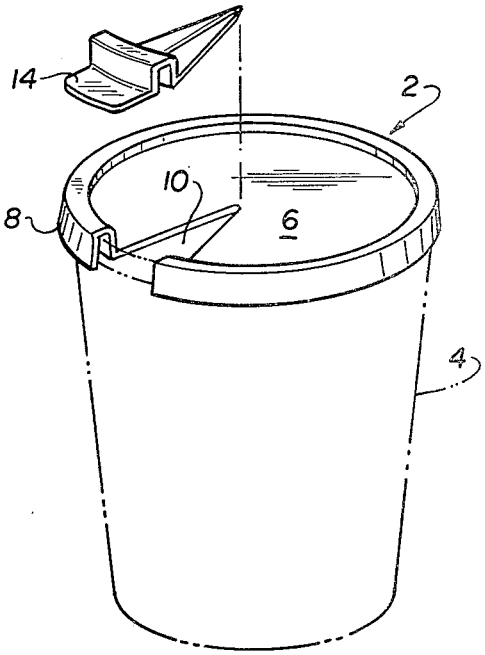
FIG. 1 shows a perspective view of the preferred embodiment.
Figure 3A:
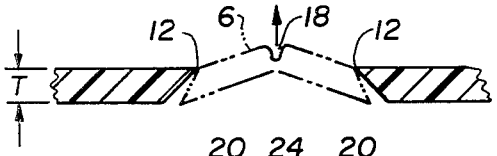
FIG. 3(a) is a cross-sectional view taken along line 3—3 of FIG. 2, showing the folding along score line 18.
Figure 3B:
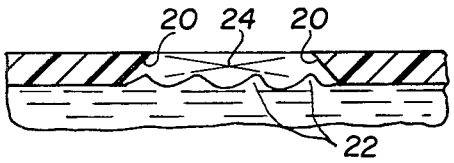
FIG. 3(b) is a cross-sectional view taken along line 3—3 of FIG. 2.
Figure 5:
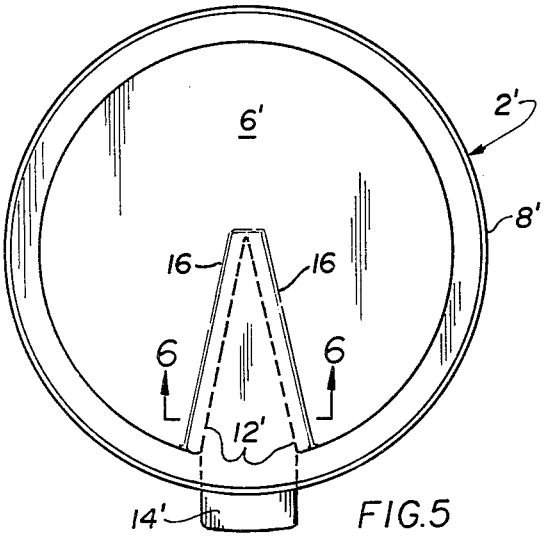
FIG. 5 is an elevational view of an alternative embodiment.
Figure 4:
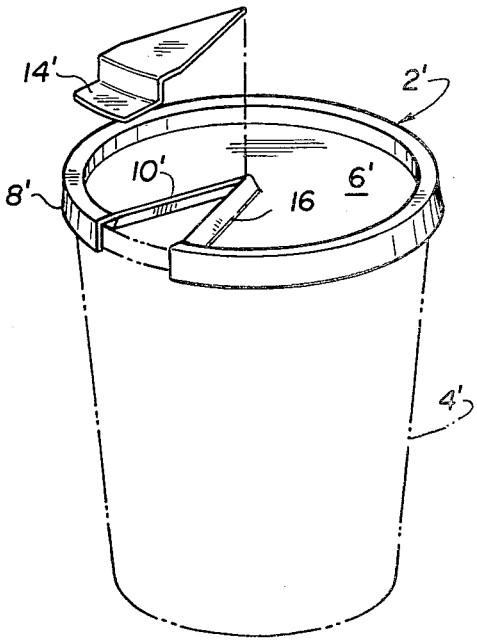
FIG. 4 is a perspective view of an alternative embodiment.
Figure 6:
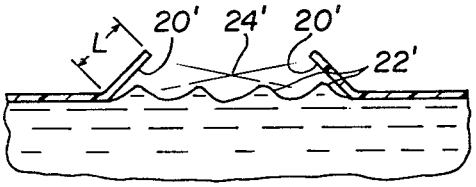
FIG. 6 is a cross-sectional view taken along line 6—6 of FIG. 5.

Referring now to the drawings, in which like reference numerals represent like parts, a closure lid, generally designated 2 is shown, which comprises a circumferential flange portion 8 and a web portion 6 intermediate thereof.

The flange 8 is adapted to grippingly but releasably engage the open end of a potable container 4 about its periphery.

In a preferred embodiment, the closure lid 2 has a thickness T. This thickness must be sufficient to interact with potable wave forms impinging thereon. Since waves of potables in containers with which the present device is to be used can be expected to average $\frac{1}{8}$ of an inch in height, and a similar dimension in width (defining the wave width as that which is measured from trough to trough), the thickness of the lid should be about $\frac{1}{8}$ of an inch. Greater thicknesses will inhibit the splashing of even greater waves. It is therefore understood that the present device may be constructed of varying thicknesses without departing from the scope of the invention as defined in the appended claims.

Sectorial perforations 12 are provided in the preferred embodiment to allow the user of the lid to pull upwardly on tab 14 thereby disengaging that portion of the lid intermediate of the perforations 12 without effecting the remaining portions of the lid 2. A drinking section 10 is created by the removal of the said lid portion. To facilitate the removal of the sectorial lid portion, a score line 18 which bisects the said portion is provided, which allows the portion to fold along its major axis when the tab is being pulled upwardly.

The perforations 12 extend through the lid 2 having thickness T at an angle relative to a horizontal plane, preferably 45°. It is understood that the angle could vary between 30° and 60° and still conform with the teachings of the present disclosure.

When the sectorial portion is removed, baffle walls 20 are thereby exposed. The inclination of the walls 20 is defined by the angle chosen when the perforations 12 are formed in the lid 2.

It is therefore seen that wave forms 22 which appear in the container 4 will impinge upon the baffle walls 20 and be quelled in part and directed toward an area of convergence 24. Mutual annihilation occurs in said area, as wave forms rebounding from opposing baffle walls collide, interact, and dissipate their respective energies.

It is understood that the perforations 12 could define a segmental, as oppposed to sectorial, drinking section 10. The uniform inclination of the baffle walls would, in such a configuration, still serve to direct the wave forms toward an area of convergence. However, a substantial percentage of wave forms would be directed toward the outer perimeter of the cup 4. Since the distance the energy pulse would have to travel in going from a point on the baffle wall 20 midway of the segmental portion to the said periphery would be less than that distance required to be traversed by pulses directed centrally by the walls disposed at the edges of the segment, the first pulses would reach the outer perimeter of the cup, and spill, prior to interception and cancellation thereof by the second pulses. Thus, it is understood that the sectorial drinking section is preferred. A sector is the geometrical figure bounded by two radii and the included arc of a circle, whereas a segment is that area of a circle bounded by a chord and an arc of the circle, or so much of the area as is cut off by the chord.

The closure lids now in common use are of a thickness insufficient in themselves to define a baffle wall or pair thereof that will interact in the above-described manner with wave forms appearing in the potable.

A second embodiment is therefore now described, which will achieve the objects of this invention in the context of lids of minimal thickness.

Sectorial perforations 12', as on the first described embodiment, are provided on the closure lid 2' to define a drinking section 10'. Since the lid is of minimal thickness in this embodiment, it is not necessary to perforate the lid at an angle, as in the first embodiment.

To nevertheless provide the requisite baffle walls, score lines 16 are provided in spaced-apart relationship to the perforations 12'. The distance between the perforations 12' and the score line 16 defines the length L of the baffle walls 20'. When the tab 14' is pulled, the score lines 16 will allow the baffle walls to fold upwardly as the perforated drinking section is removed. If the score lines do not bend as desired, leaving the drinking section without functional baffle walls, the user of the lid need merely to raise the baffle walls manually to the desired angle.

Either of the two disclosed embodiments will enhance enjoyment of drinking from potable containers of the applicable variety by reducing the risks of spillage inherent in the use thereof.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A spill-inhibiting closure lid for use with full or nearly full open ended potable containers, said lid having means for releasable engagement with the container about its periphery, said lid having a removable, wedge-shaped drinking section defined by a pair of intersecting perforation lines, and tab means for removing said wedge-shaped drinking section when potable consumption is desired; the improvement comprising,

- slanted perforations formed at an acute angle with respect to the top surface of the lid surrounding the wedge-shaped section in said lid defining said removable wedge-shaped drinking section,
- said slanted perforations extending through said lid so that removal of said drinking section exposes a pair of inclined baffle walls,
- each of said inclined baffle walls defining an overhang relative to the surface of the potable so that potable waves impinging thereon are quelled,
- and a weakening line bisecting said wedge-shaped drinking section so that the wedge-shaped portion of said lid folds inwardly when said tab means is pulled thereby facilitating the removal of said drinking section.

2. A spill-inhibiting closure lid for use with full or nearly full open ended potable containers, said lid having means for releasable engagement with the container about its periphery, said lid having a removable wedge-shaped drinking section defined by a pair of intersecting perforation lines, and tab means for removing said wedgeshaped drinking section when potable consumption is desired; the improvement comprising,

- a pair of intersecting weakening lines in spaced-apart substantially parallel relationship with said perforation lines,
- said weakening lines disposed outwardly of said perforation lines so that pulling said tab means separates said drinking section from said lid along said perforation lines and causes a portion of said lid to fold upwardly along said weakening lines,
- said portion of said upwardly folded lid defining a pair of opposed, inclined baffle walls,
- each of said inclined baffle walls defining an overhang relative to the surface of the potable so that potable waves impinging thereon are quelled.

3. The closure lid of claims 1 or 2, wherein the angle of inclination of the baffle walls is between 30° and 60°.

* * * * *